US006449466B1

(12) United States Patent
Jin et al.

(10) Patent No.: US 6,449,466 B1
(45) Date of Patent: Sep. 10, 2002

(54) ADAPTIVE DIGITAL PRE-DISTORTION CORRECTION CIRCUIT FOR USE IN A TRANSMITTER IN A DIGITAL COMMUNICATION SYSTEM AND METHOD OF OPERATION

(75) Inventors: Hang Jin, Plano; Joseph R. Cleveland, Richardson, both of TX (US)

(73) Assignee: Samsung Electronics Co., Ltd., Korea (KR)

( * ) Notice: Subject to any disclaimer, the term of this patent is extended or adjusted under 35 U.S.C. 154(b) by 0 days.

(21) Appl. No.: 09/224,193

(22) Filed: Dec. 30, 1998

(51) Int. Cl.[7] ..... H01Q 11/12

(52) U.S. Cl. ..... 455/127; 455/114; 455/115; 455/126

(58) Field of Search ..... 455/127, 114, 455/115, 126, 119; 375/296, 297

(56) References Cited

U.S. PATENT DOCUMENTS 5,351,016 A * 9/1994 Dent ..... 332/103
5,613,226 A * 3/1997 Kanami ..... 455/115
5,748,678 A * 5/1998 Valentine ..... 375/297
5,903,823 A * 5/1999 Moriyama ..... 455/126

* cited by examiner

*Primary Examiner*—Doris H. To
*Assistant Examiner*—John J Lee
(74) *Attorney, Agent, or Firm*—John C. Han

(57) ABSTRACT

There is disclosed an adaptive pre-distortion correction circuit for use in an RF transmitter having a transmit path capable of receiving a digital input baseband signal and generating a modulated RF output signal. The adaptive pre-distortion circuit comprises 1) input sampling means coupled to an input of the transmit path for capturing from a first digital input sample of amplitude X; 2) demodulation circuitry coupled to an output of the transmit path for receiving and demodulating the modulated RF output signal to produce a digital output baseband signal; 3) output sampling means coupled to the demodulation circuitry for capturing a first digital output sample corresponding to the first input sample; and 4) processing means for comparing the first digital input sample and the first digital output sample and calculating a pre-distortion correction value corresponding to the amplitude X. The pre-distortion correction value are stored in a look-up table and are continually updated to compensate for circuit changes over time.

18 Claims, 6 Drawing Sheets

ADAPTIVE DIGITAL PRE-DISTORTION CORRECTION CIRCUIT FOR USE IN A TRANSMITTER IN A DIGITAL COMMUNICATION SYSTEM AND METHOD OF OPERATION

TECHNICAL FIELD OF THE INVENTION

The present invention is directed, in general, to wireless networks and, more specifically, to an adaptive digital pre-distortion correction circuit for use in an RF transmitter.

BACKGROUND OF THE INVENTION

Wireless networks, and cellular telephone networks in particular, have become ubiquitous in society. Reliable predictions indicate that there will be over 300 million cellular telephone customers by the year 2000. In order to maximize the number of subscribers that can be serviced in a single cellular system, frequency reuse is increased by making individual cell sites smaller and using a greater number of cell sites to cover the same geographical area. To maximize usage of the available bandwidth in each cell, a number of multiple access technologies have been implemented to allow more than one subscriber to communicate simultaneously with each base transceiver station (BTS) in a wireless system. These multiple access technologies include time division multiple access (TDMA), frequency division multiple access (FDMA), and code division multiple access (CDMA). These technologies assign each system subscriber to a specific traffic channel that transmits and receives subscriber voice/data signals via a selected time slot, a selected frequency, a selected unique code, or a combination thereof.

Every cellular base station has a RF transmitter for sending voice and data signals to mobile units (i.e., cell phones, portable computers equipped with cellular modems, and the like) and a receiver for receiving voice and data signals from the mobile units. It is important that the RF power amplifier in a transmitter operate in a highly linear manner, especially when amplifying a signal whose envelope changes in time over a wide range, as in CDMA and multi-carrier systems. It also is important that the RF transmitter operate efficiently under high-power conditions. It also is important that RF amplifiers having good linearity characteristics across a wide range of operating conditions are required because wireless systems cannot tolerate large amounts of signal distortion and may not violate the IS 95 bandwidth requirements regarding spectral spreading effects.

Spurious spectral components are introduced when a signal peak is sufficiently large to saturate an RF amplifier in the transmitter. The RF transmitters in wireless networks in which digital signals have high peak-to-mean ratios, such as CDMA and multi-carrier systems, are frequently "backed off" from full power (or peak power) to avoid clipping the signal peaks. For example, RF power amplifiers in some CDMA systems need more than 10 dB of "overhead" space to protect the peak CDMA signal power from clipping. Unfortunately, leaving this much overhead significantly reduces the power efficiency of the RF power amplifier and increases the power consumption and the cooling requirements of the base transceiver station.

A number of techniques are known to try to minimize the amount of overhead an RF power amplifier requires, including feedforward, feedback, and pre-distortion. Each technique has its drawbacks, however. Feedforward systems require a large error power amplifier in the correction loop, which lowers the overall power amplifier efficiency. Feedback systems introduce a delay in the feedback signal, which limits the signal bandwidth to a few MHz. Pre-distortion systems typically exhibit low correction efficiency.

There is therefore a need in the art for improved wireless networks that use more efficient RF power amplifiers. In particular, there is a need for improved RF power amplifiers that can operate more closely to full power in systems having high peak-to-mean digital signal ratios without generating spurious spectral components when a large signal peak is encountered. More particularly, there is a need for improved RF power amplifiers that require less "overhead" to prevent sudden large peaks from being clipped due to saturation of the RF power amplifier.

SUMMARY OF THE INVENTION

To address the above-discussed deficiencies of the prior art, it is a primary object of the present invention to provide a pre-distortion correction circuit for use in an RF transmitter having a transmit path capable of receiving a digital input baseband signal and generating therefrom a modulated RF output signal. The pre-distortion correction circuit adaptively corrects an amplification distortion caused by an RF power amplifier in the transmit path. In an advantageous embodiment of the present invention, the adaptive pre-distortion circuit comprises 1) input sampling means coupled to an input of the transmit path capable of capturing from the digital input baseband signal a first input sample of amplitude X; 2) demodulation circuitry coupled to an output of the transmit path capable of receiving and demodulating the modulated RF output signal to thereby produce a digital output baseband signal; 3) output sampling means coupled to the demodulation circuitry capable of capturing a first output sample from the digital output baseband signal corresponding to the first input sample; and 4) processing means capable of comparing the first input sample and the first output sample and determining therefrom a pre-distortion correction value corresponding to the amplitude X.

According to an exemplary embodiment of the present invention, the processing means adds the pre-distortion correction value to a subsequently received input sample of amplitude X.

According to another embodiment of the present invention, the processing means comprises a table for storing the pre-distortion correction value.

According to still another embodiment of the present invention, the processing means modifies the pre-distortion correction value in response to a subsequent comparison of a second input sample of amplitude X with a second output sample corresponding to the second input sample.

According to yet another embodiment of the present invention, the processing means is capable of determining if the amplitude X is sufficiently small to ensure that the amplification distortion caused by an RF power amplifier is negligibly small and, in response to the determination, determines a scaling factor for the output samples.

According to a further embodiment of the present invention, the processing means scales the output samples, determines the pre-distortion correction values, and adds the pre-distortion correction values to the look-up table.

According to a still further embodiment of the present invention, the processing means modifies subsequently received input samples of amplitude X according to a value in the look-up table that corresponds to the amplitude X.

According to a yet further embodiment of the present invention, the processing means modifies subsequently received input samples according to a value in the look-up table regardless of the amplitude of the input samples.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

Before undertaking the DETAILED DESCRIPTION, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION

FIGS. 1 through 6, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged wireless network.

Figure 1:
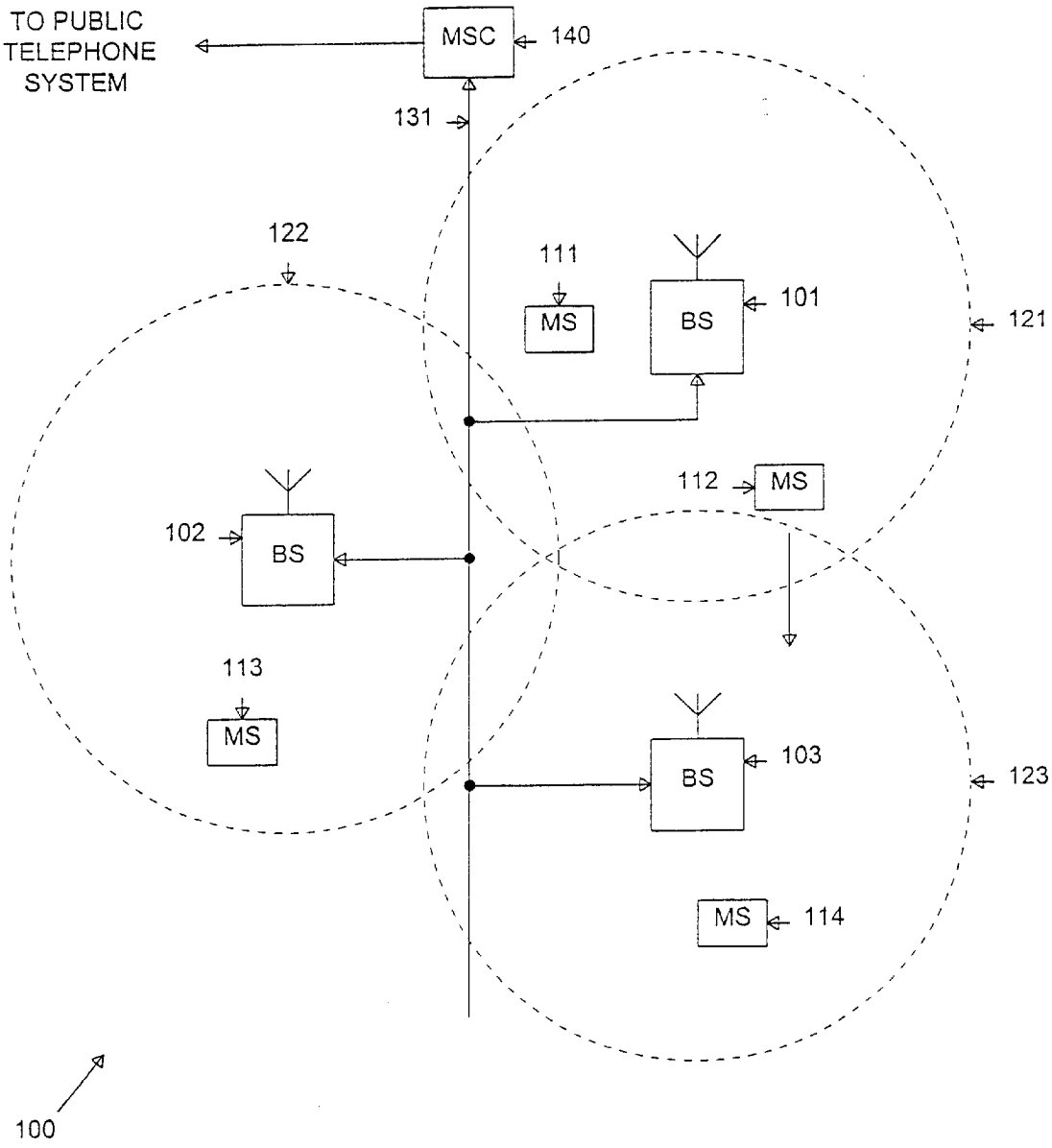
FIG. 1 illustrates an exemplary wireless network according to one embodiment of the present invention.

FIG. 1 illustrates exemplary wireless network 100 according to one embodiment of the present invention. The wireless telephone network 100 comprises a plurality of cell sites 121–123, each containing one of the base stations, BS 101, BS 102, or BS 103. Base stations 101–103 are operable to communicate with a plurality of mobile stations (MS) 111–114. Mobile stations 111–114 may be any suitable cellular devices, including conventional cellular telephones, PCS handset devices, portable computers, metering devices, and the like.

Dotted lines show the approximate boundaries of the cells sites 121–123 in which base stations 101–103 are located. The cell sites are shown approximately circular for the purposes of illustration and explanation only. It should be clearly understood that the cell sites may have other irregular shapes, depending on the cell configuration selected and natural and man-made obstructions.

In one embodiment of the present invention, BS 101, BS 102, and BS 103 may comprise a base station controller (BSC) and a base transceiver station (BTS). Base station controllers and base transceiver stations are well known to those skilled in the art. A base station controller is a device that manages wireless communications resources, including the base transceiver station, for specified cells within a wireless communications network. A base transceiver station comprises the RF transceivers, antennas, and other electrical equipment located in each cell site. This equipment may include air conditioning units, heating units, electrical supplies, telephone line interfaces, and RF transmitters and RF receivers. For the purpose of simplicity and clarity in explaining the operation of the present invention, the base transceiver station in each of cells 121, 122, and 123 and the base station controller associated with each base transceiver station are collectively represented by BS 101, BS 102 and BS 103, respectively.

BS 101, BS 102 and BS 103 transfer voice and data signals between each other and the public telephone system (not shown) via communications line 131 and mobile switching center (MSC) 140. Mobile switching center 140 is well known to those skilled in the art. Mobile switching center 140 is a switching device that provides services and coordination between the subscribers in a wireless network and external networks, such as the public telephone system. Communications line 131 may be any suitable connection means, including a T1 line, a T3 line, a fiber optic link, a network backbone connection, and the like. In some embodiments of the present invention, communications line 131 may be several different data links, where each data link couples one of BS 101, BS 102, or BS 103 to MSC 140.

In the exemplary wireless network 100, MS 111 is located in cell site 121 and is in communication with BS 101, MS 113 is located in cell site 122 and is in communication with BS 102, and MS 114 is located in cell site 123 and is in communication with BS 103. The MS 112 is also located in cell site 121, close to the edge of cell site 123. The direction arrow proximate MS 112 indicates the movement of MS 112 towards cell site 123. At some point, as MS 112 moves into cell site 123 and out of cell site 121, a "handoff" will occur.

As is well know, the "handoff" procedure transfers control of a call from a first cell to a second cell. For example, if MS 112 is in communication with BS 101 and senses that the signal from BS 101 is becoming unacceptably weak, MS 112 may then switch to a BS that has a stronger signal, such as the signal transmitted by BS 103. MS 112 and BS 103 establish a new communication link and a signal is sent to BS 101 and the public telephone network to transfer the on-going voice, data, or control signals through BS 103. The call is thereby seamlessly transferred from BS 101 to BS 103. An "idle" handoff is a handoff between cells of a mobile device that is communicating in the control or paging channel, rather than transmitting voice and/or data signals in the regular traffic channels.

Figure 2:
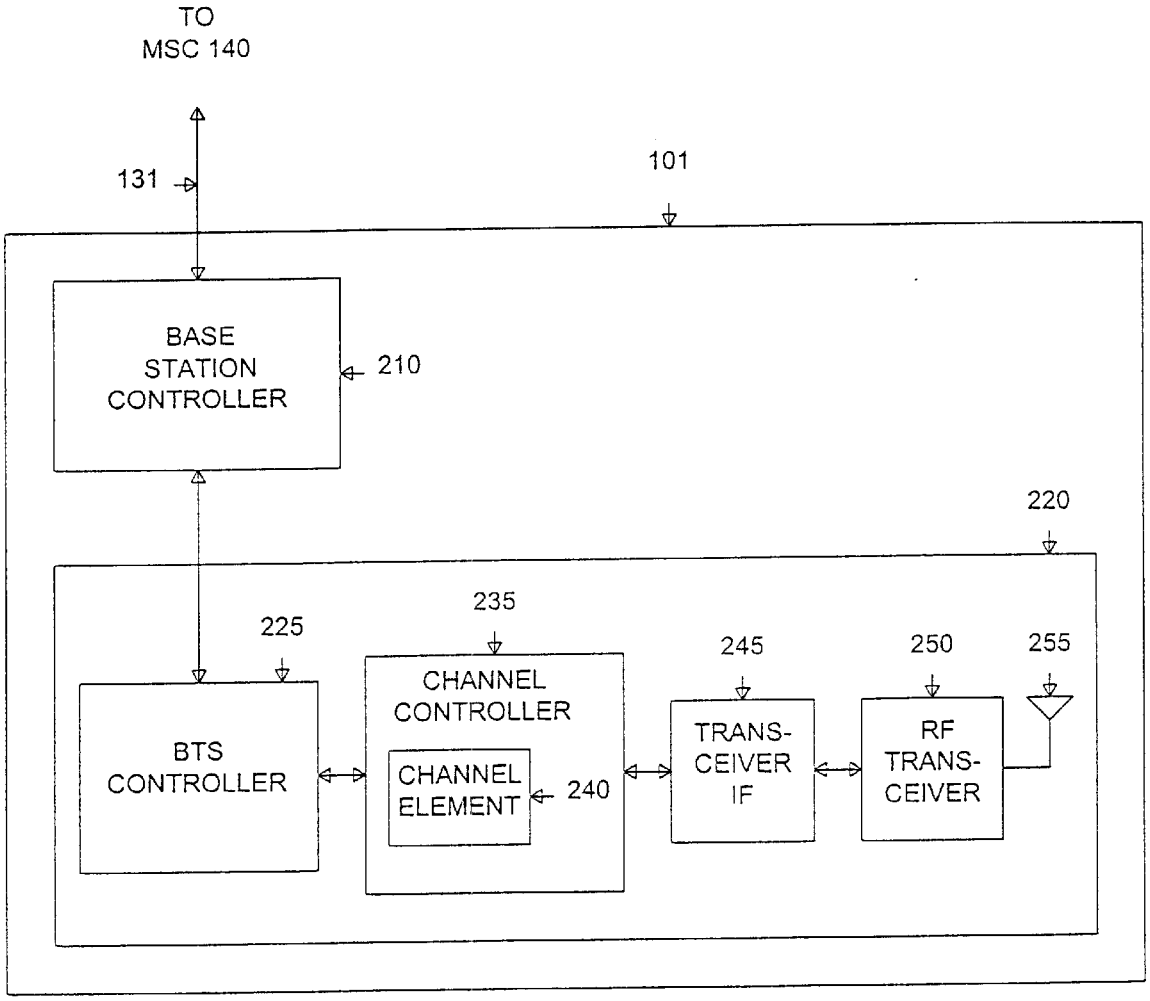
FIG. 2 illustrates in greater detail an exemplary base station in accordance with one embodiment of the present invention.

FIG. 2 illustrates in greater detail exemplary base station 101 in accordance with one embodiment of the present invention. Base station 101 comprises base station controller (BSC) 210 and base transceiver station (BTS) 220. Base station controllers and base transceiver stations were described previously in connection with FIG. 1. BSC 210 manages the resources in cell site 121, including BTS 220. BTS 120 comprises BTS controller 225, channel controller 235, which contains representative channel element 240, transceiver interface (IF) 245, RF transceiver unit 250, antenna array 255, and channel monitor 260.

BTS controller 225 comprises processing circuitry and memory capable of executing an operating program that controls the overall operation of BTS 220 and communicates with BSC 210. Under normal conditions, BTS controller 225 directs the operation of channel controller 235, which contains a number of channel elements, including channel element 240, that perform bi-directional communications in the forward channel and the reverse channel. A "forward" channel refers to outbound signals from the base station to the mobile station and a "reverse" channel refers to inbound signals from the mobile station to the base station. Transceiver IF 245 transfers the bi-directional channel signals between channel controller 240 and RF transceiver unit 250.

Antenna array 255 transmits forward channel signals received from RF transceiver unit 250 to mobile stations in the coverage area of BS 101. Antenna array 255 also sends to transceiver 250 reverse channel signals received from mobile stations in the coverage area of BS 101. In a preferred embodiment of the present invention, antenna array 255 is multi-sector antenna, such as a three sector antenna in which each antenna sector is responsible for transmitting and receiving in a 120° arc of coverage area. Additionally, transceiver 250 may contain an antenna selection unit to select among different antennas in antenna array 255 during both transmit and receive operations.

To increase the efficiency of the RF transmitters in RF transceiver 250, the present invention by implementing an adaptive digital pre-distortion correction (ADPD) circuit that samples the RF transmitter input and output signals and then synchronizes and compares the samples. The present invention then determines the pre-distortion correction required to correct the input signal and adds the pre-distortion correction to subsequent input samples of similar amplitude. The present invention theoretically can correct any distortion experienced by signals between the input and output sampling points. The present invention may be implemented in any type of digital modulation scheme, including TDMA, CDMA, GSM, multi-carrier signals, and even modems.

Figure 3:
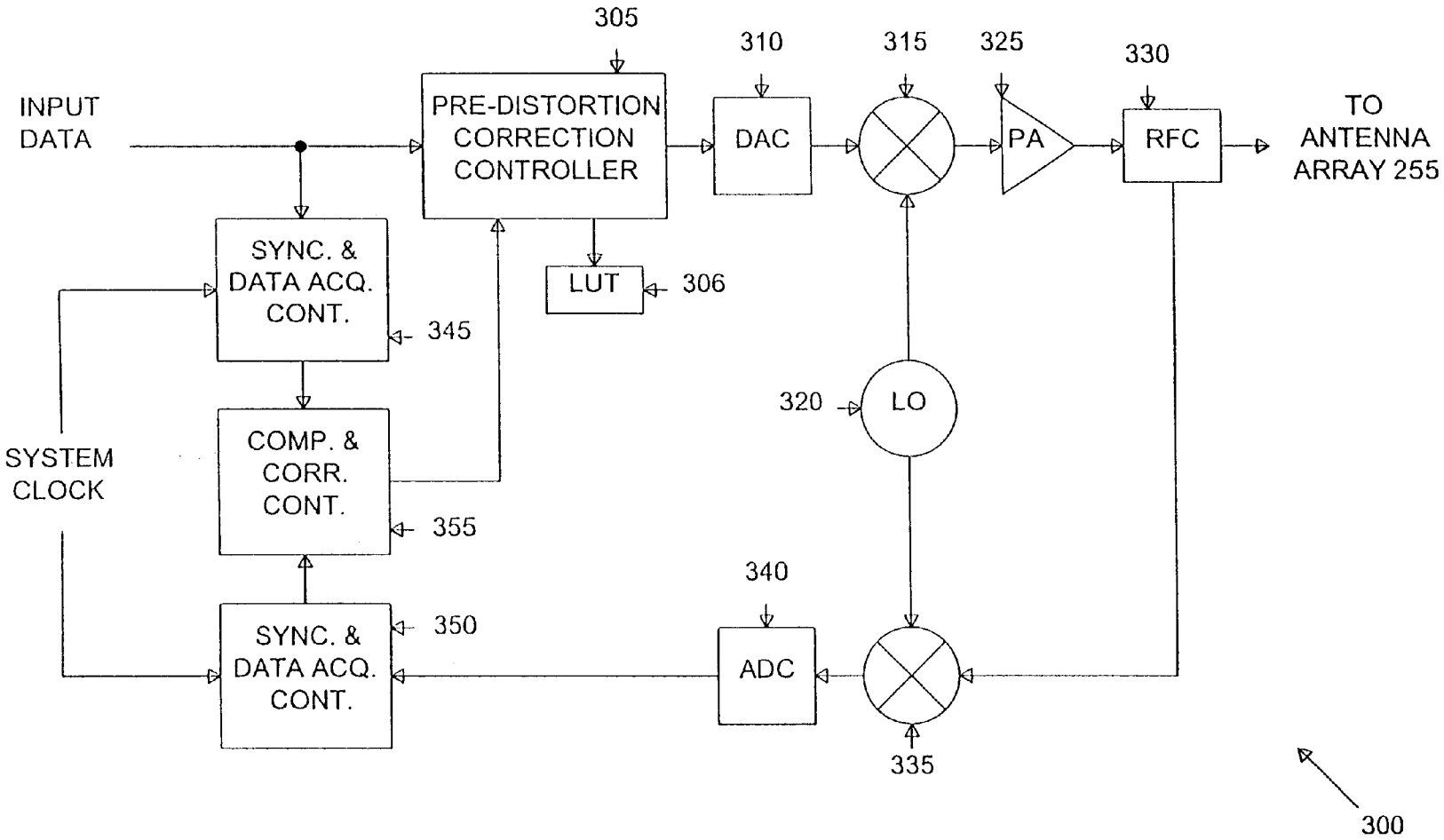
FIG. 3 illustrates an exemplary RF transmitter for use in the RF transceiver unit in FIG. 2 in accordance with one embodiment of the present invention.

FIG. 3 illustrates exemplary RF transmitter 300 for use in RF transceiver unit 250 in accordance with one embodiment of the present invention. RF transmitter 300 contains a transmit path that receives input data and generates an RF output signal that is sent to antenna array 255. The transmit path elements in RF transmitter 300 comprise pre-distortion correction controller 305, look-up table (LUT) 306, digital-to-analog converter (DAC) 310, RF modulator 315, local oscillator 320, RF power amplifier (PA) 325, and RF coupler (RFC) 330.

RF transmitter 300 also contains a pre-distortion correction feedback loop that samples the input data signal and a corresponding part of the RF output signal, compares the samples, and generates a pre-distortion correction signal that is added to subsequent samples of the input signal data. The pre-distortion correction feedback loop elements in RF transmitter 300 comprise RF demodulator 335, local oscillator 320, analog-to-digital converter (ADC) 340, input synchronization and data acquisition controller 345, output synchronization and data acquisition controller 350 and comparison and correction controller 355.

A digital baseband signal, referred to as "INPUT DATA" in FIG. 3, is received by pre-distortion correction controller 305, which may optionally add a pre-distortion error correction retrieved from LUT 306 before sending the INPUT DATA signal to DAC 310. DAC 310 converts the digital signal to an analog signal that forms the baseband input to RF modulator 315. The other input to RF modulator is a reference RF carrier signal from local oscillator 320. The output of RF modulator 315 is an RF signal modulated by the baseband signal. Next, the modulated RF signal is amplified by RF power amplifier 325 to a power level suitable for transmission. The amplified modulated RF output signal is then sent to antenna array 255 via RFC 330.

Those skilled in the art will recognize that the above-described modulation and amplification steps are common operations in conventional RF transmitters. If the amplitude of the INPUT DATA signal is relatively low, RF power amplifier 325 operates well within the linear region and little or no distortion is introduced in the RF output signal sent to antenna array 255. However, as the amplitude of the INPUT DATA signal rises, RF power amplifier 325 begins to saturate (i.e., operates in a non-linear manner) and distortion is introduced in the RF output signal sent to antenna array 255. To compensate for this condition, a pre-distortion signal is added to the INPUT DATA signal by pre-distortion correction controller 305.

The pre-distortion correction signal is determined by the operation of input synchronization and data acquisition controller 345, output synchronization and data acquisition controller 350 and comparison and correction controller 355. RFC 330 sends a copy of the RF output signal to RF demodulator 335. The other input to RF demodulator 335 is the same carrier reference signal from local oscillator 320 that was used by RF modulator 315 to produce the original RF modulated signal. The output of RF demodulator 335 is a scaled version of the original analog baseband signal generated by DAC 310, plus possible distortion components. The scaled, distorted analog baseband is converted by ADC 340 to digital values that are read by output synchronization and data acquisition controller 350.

Figure 4:
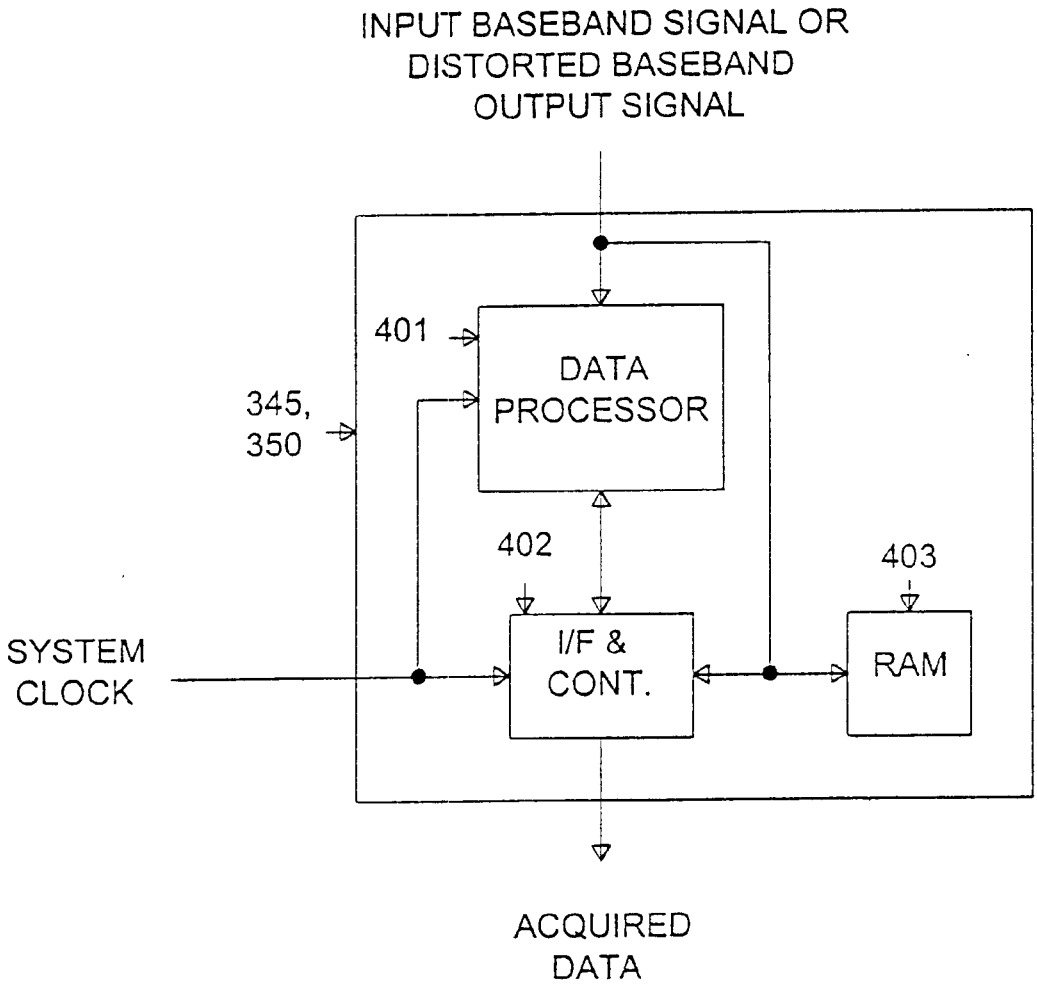
FIG. 4 illustrates exemplary input and output synchronization and data acquisition controllers in accordance with one embodiment of the present invention.

FIG. 4 illustrates exemplary input synchronization and data acquisition controller (ISDAC) 345 and output synchronization and data acquisition controller (OSDAC) 350 in accordance with one embodiment of the present invention. The operations of ISDAC 345 and OSDAC 350 are quite similar, as explained below in greater detail.

ISDAC 345 comprises data processor 401, interface (I/F) and control circuit 402, and RAM 403. A system clock provides a reference for clocking the input digital baseband signal (i.e., INPUT DATA) into data processor 401 and clocking the acquired data out of interface and control circuit 402. The INPUT DATA signal samples are stored in RAM 403. Data processor 401 comprises a signal correlator that analyzes the bits in the INPUT DATA signal to determine the start and stop of N-bit data samples, where "N" is a known system parameter that varies depending on the type of system wireless network 100 is (i.e., CDMA, GSM, TDMA, etc.). The N-bit samples begin with a recognizable marker that denotes the start of the N-bit sample. When an entire N-bit sample has been detected and captured (acquired), data processor 401 sends a signal to interface and control circuit 402 which transfers the acquired data to comparison and correction controller 355.

Similarly, OSDAC 350 comprises data processor 401, interface (I/F) and control circuit 402, and RAM 403. A system clock provides a reference for clocking the distorted output digital baseband signal into data processor 401 and clocking the acquired data out of interface and control circuit 402. The distorted output digital baseband signal samples are stored in RAM 403. Data processor 401 comprises a signal correlator that analyzes the bits in the distorted output digital baseband signal to determine the start and stop of the N-bit data samples. The N-bit samples are the same N-bit samples that are contained in the INPUT DATA signal. Even though the output digital baseband signal may be distorted, enough of the bits remain unchanged to enable the signal correlator in data processor 401 to recognize the marker that denotes the start of the N-bit sample. When an entire N-bit sample has been detected and captured (acquired), data processor 401 sends a signal to interface and control circuit 402 which transfers the acquired data to comparison and correction controller 355.

Comparison and correction controller 355 comprises comparison circuitry for comparing the acquired data received from ISDAC 345 and OSDAC 350. Comparison and correction controller 355 can therefore perform a bit-by-bit comparison of an N-bit input sample and the corresponding distorted N-bit output sample. Once the amount of distortion has been determined comparison and correction controller 355 generates a pre-distortion error correction value that is sent to pre-distortion correction controller 305 and stored in look-up table (LUT) 306. Thereafter, as pre-distortion correction controller 305 receives sub-sequent N-bit samples of the INPUT DATA signal, pre-distortion correction controller 305 can look-up the pre-distortion error correction corresponding to the amplitude of the N-bit sample and add the pre-distortion error correction.

Figure 5:
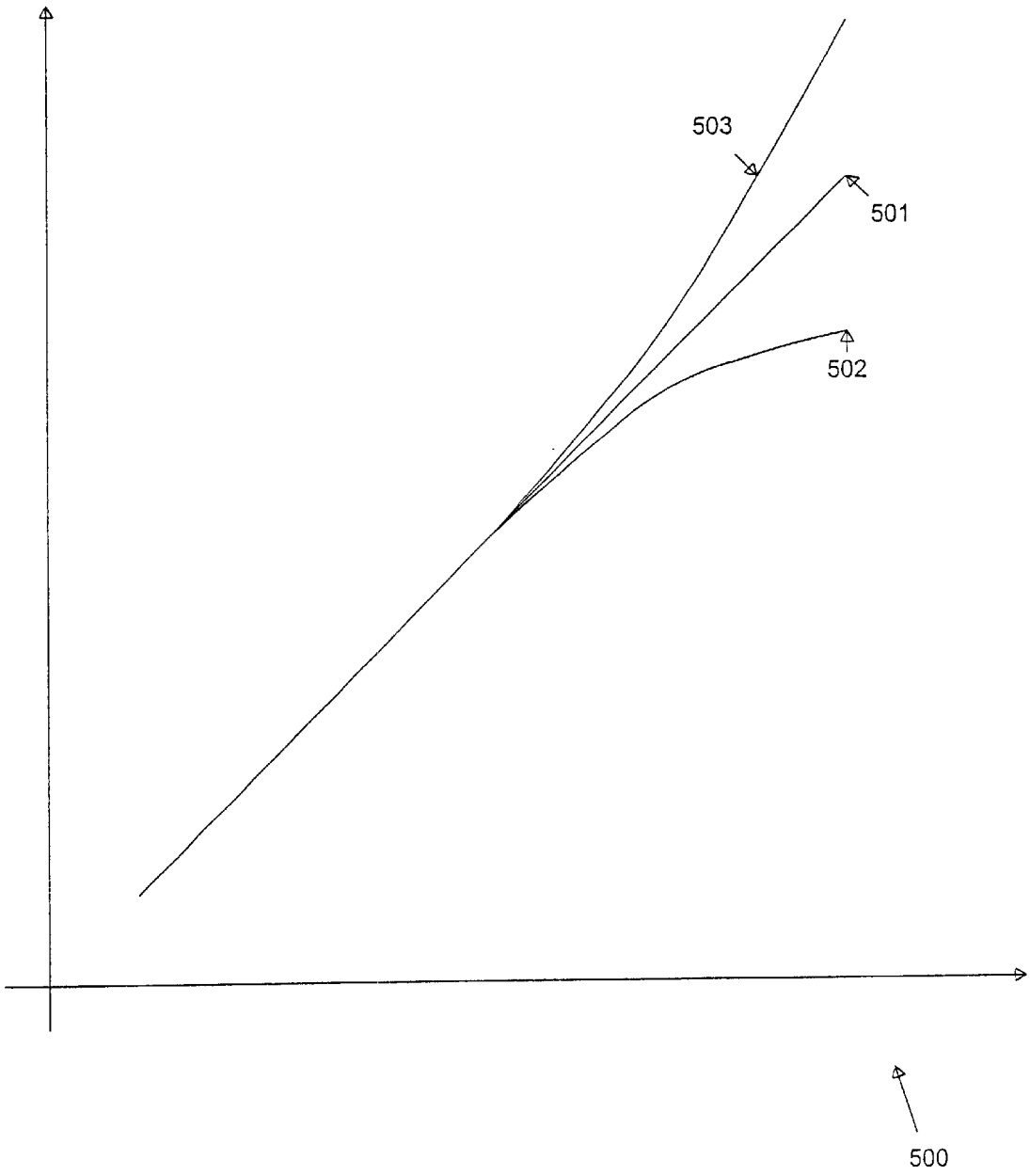
FIG. 5 is an input power-output power diagram illustrating an exemplary pre-distortion error correction operation in accordance with one embodiment of the present invention.

FIG. 5 depicts an input power-output power diagram 500 which illustrates an exemplary pre-distortion error correction operation in accordance with one embodiment of the present invention. Lines 501–503 in FIG. 5 are intended only to help in the explanation of the error correction operation and are not intended to be drawn to scale. Those skilled in the art will recognize that the relative slopes, curvatures and separations of lines 501–503 will necessarily vary according to the RF power amplifier type and according to environmental conditions.

Line 501 depicts the input/output response of RF power amplifier 325 under ideal linear operating conditions. As the amplitude of the input signal (horizontal axis) rises, the amplitude of the output signal (vertical axis) rises according to a steady slope, indicating constant amplifier gain. Line 502 depicts the input/output response of RF power amplifier 325 under real-world non-linear operating conditions. As the amplitude of the input signal rises, the amplitude of the output signal rises according to a steady slope only up to a certain point, at which time RF power amplifier 325 being to saturate and amplifier gain becomes non-linear.

Line 503 indicates the pre-distortion correction values stored in LUT 306 and added by pre-distortion correction controller 305 as the input signal rises to the point where saturation occurs. The pre-distortion correction values compensate for the fall-off of line 502 from the ideal line 501 to thereby make the output of RF power amplifier 325 more like the ideal linear output of line 501. In an advantageous embodiment of the present invention, the pre-distortion correction circuitry of RF transmitter 300 operate in an iterative manner, such that the pre-distortion correction values in LUT 306 are constantly updated and refined over time. Thus, the pre-distortion correction value for an input peak of amplitude X is calculated the first time an input peak of amplitude X is encountered and is stored in LUT 306. The second time an input peaks of amplitude X is encountered, the pre-distortion correction value is added to amplitude X, the corrected output is measured, and the pre-distortion correction value is re-calculated to determine if further correction is needed. This process constantly repeats, thereby making the pre-distortion correction values in LUT 306 more accurate and modifying the pre-distortion correction values as temperature and operating frequency change and as RF power amplifier 325 ages.

Figure 6:
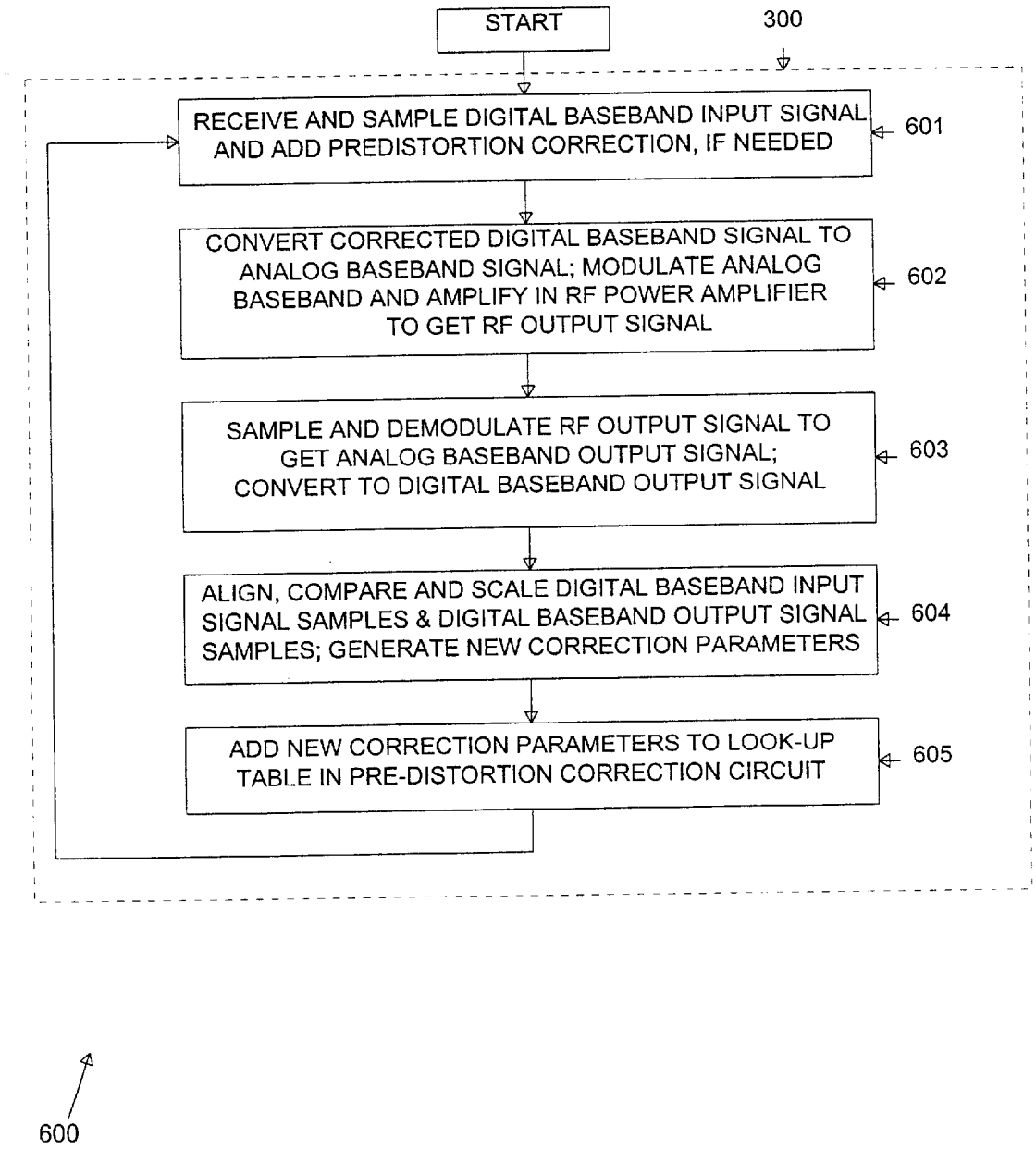
FIG. 6 is a flow diagram illustrating the operation of RF transmitter in accordance with one embodiment of the present invention.

FIG. 6 depicts flow diagram 600, which illustrates the operation of RF transmitter 300 in accordance with one embodiment of the present invention. First, during routine operation, pre-distortion correction controller 305 receives N-bit samples of the digital baseband input signal and adds a pre-distortion correction value, if any (process step 601). The corrected (or "pre-corrected") digital baseband signal is converted to a corrected analog baseband signal, which is used to modulate an RF carrier signal. The modulated RF signal is then amplified in RF power amplifier 325 (process step 602).

In the pre-distortion correction loop, the RF output signal is demodulated in RF demodulator 335 to recover the analog baseband output signal, which may be distorted. The analog baseband output signal is converted to a digital signal and sampled (process step 603). Next, the original digital baseband input signal samples are aligned with and compared to the digital baseband output signal samples. A scaling factor (small signal close loop-gain) is determined by comparing digital baseband input signals having small amplitudes with their corresponding digital baseband output signals. The digital baseband output signals are then divided by this scaling factor and compared to the digital baseband input signals and new pre-distortion correction values are calculated (process step 604). Finally, the new pre-distortion correction samples are stored in LUT 306 for use by pre-distortion correction controller 305 (process step 605). Thereafter, the process repeats by looping back to process step 601, thereby giving the present invention its adaptive nature. The pre-distortion correction values are constantly updated and corrected to compensate for changes in RF transmitter 300 over time.

Although the present invention has been described in detail, those skilled in the art should understand that they can make various changes, substitutions and alterations herein without departing from the spirit and scope of the invention in its broadest form.

What is claimed is:

1. For use in an RF transmitter having a transmit path capable of receiving a digital input baseband signal and generating therefrom a modulated RF output signal, a pre-distortion correction circuit for correcting an amplification distortion caused by an RF power amplifier in said transmit path, said pre-distortion circuit comprising:

input sampling means coupled to an input of said transmit path capable of capturing from said digital input baseband signal a first input sample of amplitude X;

demodulation circuitry coupled to an output of said transmit path capable of receiving and demodulating said modulated RF output signal to thereby produce a digital output baseband signal;

output sampling means coupled to said demodulation circuitry capable of capturing a first output sample from said digital output baseband signal corresponding to said first input sample; and processing means capable of comparing said first input sample and said first output sample and determining therefrom a pre-distortion correction value corresponding to said amplitude X, wherein said processing means is capable of determining if said amplitude X is sufficiently small to ensure that said amplification distortion caused by an RF power amplifier is negligibly small and, in response to said determination, is capable of determining a scaling factor for output samples.

2. The pre-distortion correction circuit set forth in claim 1 wherein said processing means adds said pre-distortion correction value to a subsequently received input sample of amplitude X.

3. The pre-distortion correction circuit set forth in claim 1 wherein said processing means comprises a table for storing said pre-distortion correction value.

4. The pre-distortion correction circuit set forth in claim 1 wherein said processing means modifies said pre-distortion correction value in response to a subsequent comparison of a second input sample of amplitude X with a second output sample corresponding to said second input sample.

5. The pre-distortion correction circuit set forth in claim 1 wherein said processing means adds said pre-distortion correction value to a subsequently received input sample of amplitude X.

6. The pre-distortion correction circuit set forth in claim 1 wherein said processing means modifies subsequently received input samples of amplitude X according to a value of said scaling factor.

7. The pre-distortion correction circuit set forth in claim 1 wherein processing means modifies a selected subsequently received input sample according to a value of said scaling factor without regard to an amplitude of said selected subsequently received input sample.

8. A wireless network capable of communicating with a plurality of mobile stations located in a coverage area of said wireless network, said wireless network comprising:

a plurality of base stations capable of wirelessly communicating with said plurality of mobile stations, at least one of said plurality of base stations comprising an RF transmitter having a transmit path capable of receiving a digital input baseband signal and generating therefrom a modulated RF output signal, said RF transmitter comprising:

a pre-distortion correction circuit for correcting an amplification distortion caused by an RF power amplifier in said transmit path, said pre-distortion circuit comprising:

input sampling means coupled to an input of said transmit path capable of capturing from said digital input baseband signal a first input sample of amplitude X;

demodulation circuitry coupled to an output of said transmit path capable of receiving and demodulating said modulated RF output signal to thereby produce a digital output baseband signal;

output sampling means coupled to said demodulation circuitry capable of capturing a first output sample from said digital output baseband signal corresponding to said first input sample; and processing means capable of comparing said first input sample and said first output sample and determining therefrom a pre-distortion correction value corresponding to said amplitude X wherein said processing means is capable of determining if said amplitude X is sufficiently small to ensure that said amplification distortion caused by an RF power amplifier is negligibly small and, in response to said determination, is capable of determining a scaling factor for output samples.

9. The wireless network set forth in claim 8 wherein said processing means adds said pre-distortion correction value to a subsequently received input sample of amplitude X.

10. The wireless network set forth in claim 8 wherein said processing means comprises a table for storing said pre-distortion correction value.

11. The wireless network set forth in claim 8 wherein said processing means modifies said pre-distortion correction value in response to a subsequent comparison of a second input sample of amplitude X with a second output sample corresponding to said second input sample.

12. The wireless network set forth in claim 8 wherein said processing means adds said pre-distortion correction value to a subsequently received input sample of amplitude X.

13. The wireless network set forth in claim 8 wherein said processing means modifies subsequently received input samples of amplitude X according to a value of said scaling factor.

14. The wireless network set forth in claim 8 wherein said processing means modifies a selected subsequently received input sample according to a value of said scaling factor without regard to an amplitude of said selected subsequently received input sample.

15. For use in a wireless network comprising a plurality of base stations capable of communicating with a plurality of mobile stations located in a coverage area of the wireless network, a method of operating an RF transmitter in one of the plurality of base stations, the RF transmitter having a transmit path capable of receiving an input baseband signal and generating therefrom a modulated RF output signal, the method comprising the steps of:

capturing from the digital input baseband signal a first input sample of amplitude X;

demodulating the modulated RF output signal to thereby produce a digital output baseband signal;

capturing a first output sample from the digital output baseband signal corresponding to the first input sample; and comparing the first input sample and the first output sample and determining therefrom a pre-distortion correction value corresponding to the amplitude X; and determining a scaling factor using input and output samples of signals whose amplitude X is below a previously determined threshold and, therefore, subject to only negligible distortion.

16. The method set forth in claim 15 including the further step of adding the pre-distortion correction value to a subsequently received input sample of amplitude X.

17. The method set forth in claim 15 including the further step of storing the pre-distortion correction value in a look-up table in a memory.

18. The method set forth in claim 15 including the further step of modifying the pre-distortion correction value in response to a subsequent comparison of a second input sample of amplitude X with a second output sample corresponding to the second input sample.

* * * * *